United States Patent [19]

Kuchinsky et al.

[11] 4,407,934

[45] Oct. 4, 1983

[54] METHOD OF MAKING AN ASSEMBLY OF ELECTRODES

[75] Inventors: Saul Kuchinsky, Bridgewater, N.J.; Robert H. Bellman, Horseheads, N.Y.; James A. Ogle, Neshanic Station, N.J.

[73] Assignee: Burroughs Corporation, Detroit, Mich.

[21] Appl. No.: 327,598

[22] Filed: Dec. 4, 1981

[51] Int. Cl.[3] ..... G03C 5/00

[52] U.S. Cl. ..... 430/314; 430/330; 430/313; 156/628; 156/643; 156/644; 156/657; 445/37

[58] Field of Search ..... 430/313, 314, 330; 29/25.13, 25.14, 25.15, 25.16; 313/188, 201, 220; 315/169.4; 316/20, 25, 30; 156/630, 632, 633, 644, 657, 628

[56] References Cited

U.S. PATENT DOCUMENTS

| | | | |
|---|---|---|---|
| 2,628,160 | 2/1953 | Stookey | 41/45 |
| 2,684,911 | 7/1954 | Stookey | 106/52 |
| 2,879,147 | 3/1959 | Baker | 156/628 |
| 2,933,648 | 4/1960 | Bentley . | |
| 2,971,853 | 2/1961 | Stookey | 106/52 |
| 3,687,513 | 8/1972 | Holz | 316/20 |
| 3,704,052 | 11/1972 | Coleman . | |
| 3,776,613 | 12/1973 | Van Esdonk et al. . | |
| 3,781,984 | 1/1974 | Maeda et al. . | |
| 3,787,106 | 1/1974 | Schermerhorn . | |
| 3,789,470 | 2/1974 | Owaki et al. . | |
| 3,973,815 | 8/1976 | Bode et al. . | |
| 4,092,166 | 5/1978 | Olsen et al. | 430/323 |
| 4,108,521 | 8/1978 | Wicher, Jr. | 316/17 |
| 4,276,335 | 6/1981 | Lemmond | 428/131 |

*Primary Examiner*—John E. Kittle
*Assistant Examiner*—Jose G. Dees
*Attorney, Agent, or Firm*—Kevin R. Peterson; Robert A. Green; David G. Rasmussen

[57] ABSTRACT

This invention is directed to the making of an electrode assembly which comprises providing anode electrodes on one surface of a photosensitive glass plate, providing cathode electrodes on the opposite surface of said glass plate oriented transversely to said anode electrodes, and dissolving away the plate material in alignment with said anode electrodes forming slots extending between the surfaces of said plate, thereby placing said anode and cathode electrodes in operative relation with each other.

12 Claims, 6 Drawing Figures

METHOD OF MAKING AN ASSEMBLY OF ELECTRODES

BACKGROUND OF THE INVENTION

U.S. application Ser. No. 327,597, filed concurrently herewith by the present inventors, titled Method of Making An Electrode Assembly, points out that there are numerous types of electronic devices, such as dot matrix display panels, which involve the use of two sets of electrodes spaced apart but in operative relation with one another. The text also notes that the electrodes are supported and separated by a body of electrical insulating material in which are located slots, holes, grooves, or other open passages which are frequently difficult to make and, consequently, greatly increase the cost of the assemblies.

A discussion is also provided disclosing the prior use of glasses, glass-ceramics, and ceramics for fabricating supporting structures for use in electronic devices, and the problems encountered. Glasses, glass-ceramics, and sintered ceramics demonstrate high refractoriness, good chemical resistance to the ambient environment, relative inertness to impinging radiations of various wavelengths, and high mechanical strength but are difficult to drill, punch, or otherwise mechanically shape into complex geometries.

Finally, U.S. Pat. Nos. 2,628,160, dated Feb. 10, 1953, 2,684,911, dated July 27, 1954, and 2,971,853, dated Feb. 14, 1961, of Stanley D. Stookey, are reviewed. The first two patents describe thermally opacifiable glass compotions which exhibit photosensitivity and the capability of being chemically machined to fine tolerances, and the third patent describes the production of glass-ceramic bodies which also demonstrate photosensitivity and the capability of being chemically sculptured.

The opal glasses described consist essentially, expressed in weight percent on the oxide basis, of 9–15% $Li_2O$, 0–8% total $Na_2O$ and/or $K_2O$, 9–23% $Li_2O+Na_2O+K_2O$, 70–85% $SiO_2$, 0.001–0.020% Ag, computed as AgCl, 0–10% $Al_2O_3$, 0–2.4% F, and 0–0.05% $CeO_2$. When portions of such glass bodies are exposed to short wave radiation, customarily ultraviolet radiation, a latent image is produced in those portions. Subsequent heat treatment of at least those portions of the glass bodies at temperatures generally below the softening point of the glass causes the development of crystallites of a lithium silicate and/or an alkali metal fluoride therein which impart opacity thereto. Those crystals are much more soluble in mineral acids, e.g., dilute hydrofluoric acid, than the surrounding glass. Advantage has been taken of this solubility differential between the crystallites and the residual glass to implement the chemical machining or sculpturing of such glass articles into very complex configurations and to produce holes therein without the need for mechanical tools.

The glass-ceramic articles disclosed in U.S. Pat. No. 2,971,853 consist essentially, expressed in weight percent on the oxide basis, of 60–85% $SiO_2$, 5.5–15% $Li_2O$, 2–25% $Al_2O_3$, the ratio $Al_2O_3$:$Li_2O$ being less than 1.7:1, and a photosensitive metal in the indicated proportions selected from the group of 0.001–0.03% gold, computed as Au, 0.001–0.3% silver, computed as AgCl, and 0.001–1% copper, computed as CuO. When portions of glass bodies having compositions within those cited ranges are exposed to short wave radiation, normally ultraviolet radiation, a latent image is produced in those portions. Thereafter, at least those previously-exposed areas of glass bodies are subjected to a two-step heat treatment. Thus, those portions are initially subjected to temperatures between the annealing and softening points of the glass, and then to temperatures above the softening point of the glass. This latter step effects crystallization in situ in the previously-exposed portions of the bodies, the unexposed portions being essentially unchanged. The exposed areas are highly crystalline and include at least one lithium-containing crystal phase which is more readily soluble in mineral acids, e.g., dilute hydrofluoric acid, than the residual glass. These glass-ceramic articles are mechanically stronger and possess the capability of being used in higher temperature applications than the above-discussed photosensitive opal glasses.

Chemically-sculpturable, photosensitive glasses and glass-ceramics have been employed commercially in a number of applications including electronic and fluidic devices where grooves, slots, holes, etc., of high tolerances have been etched therein. For example, Corning Glass Works, Corning, New York, has marketed a chemically machinable, photosensitive glass product under the trademark FOTOFORM and chemically machinable glass-ceramic product under the trademark FOTOCERAM.

OBJECTIVES OF THE INVENTION

The principal objective of the invention is to provide an improved method for fabricating electrode assemblies comprising two sets of electrodes spaced apart in operative relation with each other in which the supporting structure therfor is of such complex geometry that removal of material from the supporting structure is conventionally demanded, said inventive method eliminating the need for machining, milling, drilling, punching, or other mechanical means for removing material from the supporting structure.

Another objective of the invention is to fabricate electrode assemblies which can be incorporated into gas-filled display panels or into other types of devices that utilize crossed electrodes and cell matrices.

SUMMARY OF THE INVENTION

The method of the invention comprises five general steps:

First, a plate of photosensitive, electrical insulating material is exposed to actinic radiation, commonly ultraviolet radiation, to develop a latent image therein in a selected pattern;

Second, said plate is heat-treated in a manner to develop a phase in the previously-exposed portions which can be selectively chemically remove from said plate material;

Third, an array of electrodes, e.g., anodes, is disposed onto one surface of said plate in alignment with said exposed and developed portions;

Fourth, an array of electrodes, e.g., cathodes is disposed onto the opposite surface of said plate oriented transversely to said first array of electrodes;

Fifth, said plate in at least said exposed and developed portions is contacted with a solvent to selectively remove said phase in said exposed and developed portions, thereby producing slots in said plate and placing said arrays of electrodes in operative relation with each other.

DESCRIPTION OF THE INVENTION

The detailed description following is drawn to photosensitive glasses and glass-ceramics of the types disclosed in U.S. Pat. Nos. 2,628,160 and 2,971,853, supra, because of their intrinsic high mechanical strength, good weathering resistance, relative inertness to radiations of various wave lengths, relatively high mechanical strength, and low vapor pressure.

Figure 1:
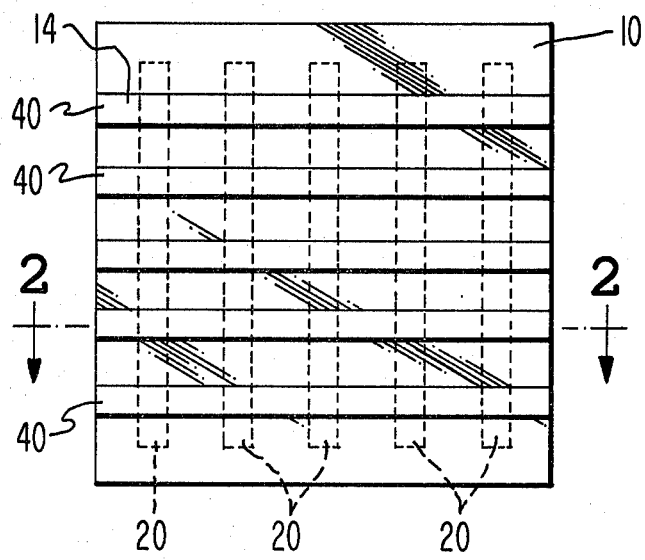
FIG. 1 is a plan view of a plate of electrical insulating material at one stage in the preparation of an assembly according to the inventive method.
Figure 2:
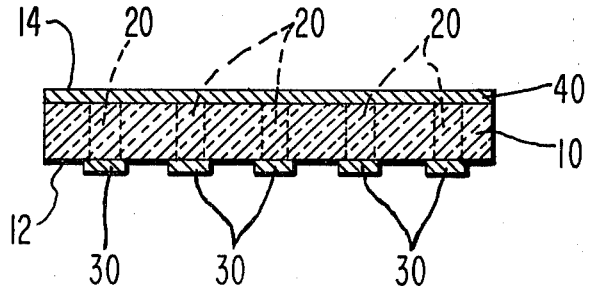
FIG. 2 is a sectional view through the plate of FIG. 1 along the lines 2—2 in FIG. 1.

Adverting now to the appended drawings and to FIG. 1, a plate 10 of a photosensitive glass is subjected to collimated ultraviolet radiation through a patterned mask composed of material opaque to ultraviolet radiation, or in some other manner, to produce latent images in the form of parallel, linear exposed regions 20 which pass through the body of plate 10 as is seen in FIG. 2. It can be observed in FIG. 1 that regions 20 do not extend to the edges of plate 10. This practice enables the edge portions of plate 10 to remain in place, thereby serving to maintain the integrity of plate 10 when portions thereof are subsequently removed from exposed regions 20. It will be recognized, of course, that other arrangements can be devised to hold plate 10 together after exposed regions 20 have been chemically removed. Plate 10 is then heated to a temperature generally below the softening point of the glass, but above the transformation range thereof, to develop crystallites in exposed regions 20 selected from the group of a lithium silicate and an alkali metal fluoride.

Next, as is depicted in FIG. 2, an array of parallel, linear electrodes 30, to be operated as anode electrodes, is formed by any suitable process, on the bottom surface 12 of plate 10. Electrodes 30 are aligned with exposed and developed regions 20. As illustrated in FIG. 2, anodes 30 are represented as flat, strip-like bodies which may be of any suitable width.

Figure 3:
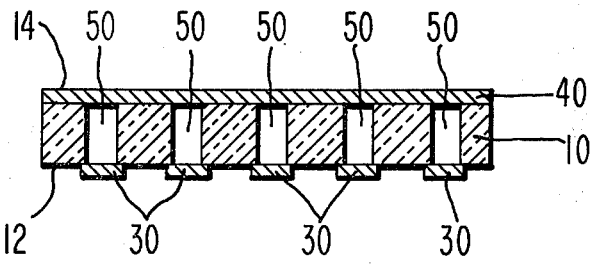
FIG. 3 illustrates the composite article formed incorporating the plate of FIG. 2 at a later stage in the preparation of an assembly according to the inventive method.
Figure 4:
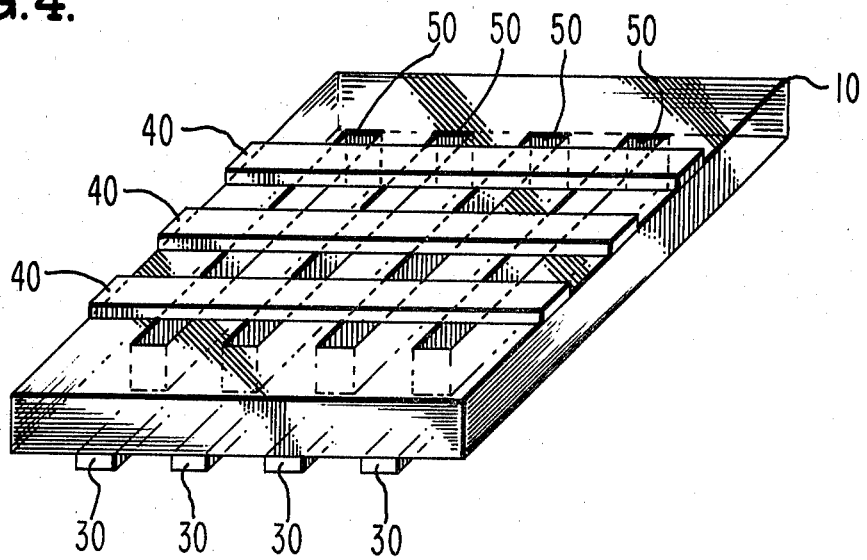
FIG. 4 is a perspective view of the completed assembly prepared from the composite article of FIG. 3.

Thereafter, as is shown in FIG. 3, an array of parallel, linear electrodes 40, to be operated as glow cathodes, is applied via any convenient technique to the top surface 14 of plate 10 oriented transversely to anode electrodes 30. FIGS. 3 and 4 represent these cathodes as flat-strip-like bodies of any desired width.

The crystallized portions 20 are contacted with a mineral acid, e.g., dilute hydrofluoric acid, to dissolve those portions, thereby forming open slots 50 and leaving a structure as represented in FIG. 3. Hence, an assembly is fabricated, as illustrated in FIG. 4, which comprises plate 10 having an array of slots 50 with an anode electrode 30 aligned with each slot and a plurality of cathode electrodes 40 disposed across slots 50. This assembly, after the attachment of leads thereto, can be incorporated into a gas-filled display panel or other type of device.

It will be appreciated that the anodes and cathodes can be formed from any suitable material which is highly electrically conducting and exhibits a coefficient of thermal expansion relatively closely matching that of the plate material. Customarily, the electrodes will be metallic, fabricated from stainless steel, nickel, or an alloy demonstrating the required expansion properties. Methods for applying the electrodes include, but are not limited to, evaporation, silk screening, RF sputtering, electroless metal and galvanic plating, and vapor deposition.

Furthermore, it will be understood that configurations other than rectilinear slots, for example, V-shaped grooves and arc-shaped channels, will likewise be operable in the final assembly.

Figure 5:
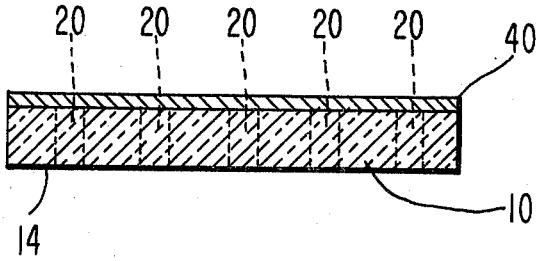
FIG. 5 is a sectional view of a modification of the inventive assembly.
Figure 6:
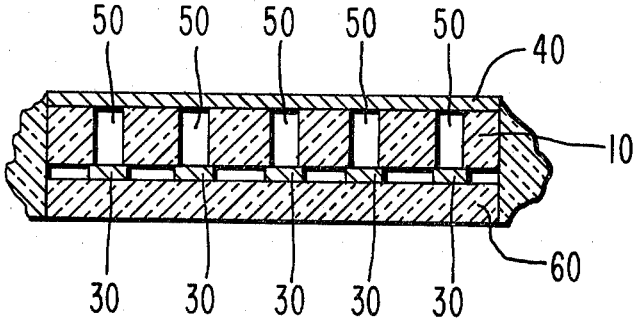
FIG. 6 is a sectional view of the assembly of FIG. 5 at a later stage in its preparation.

FIGS. 5 and 6 illustrate a modification of the basic method depicted in FIGS. 1–4. Thus, plate 10 is subjected to collimated ultraviolet radiation through a patterned mask to produce latent images in the form of parallel, linear exposed regions 20 which pass through the body of plate 10. Thereafter, plate 10 is heat-treated at temperatures between the transformation range and the softening point of the glass to develop crystallites selected from the group of a lithium silicate and an alkali metal fluoride in regions 20.

An array of parallel, linear cathode electrodes 40 is applied via any suitable method to the top surface 14 of plate 10 in transverse orientation to crystallized regions 20. A plurality of parallel, linear anodes 30 is applied through any convenient means to the surface of support plate 60. Support plate 60 is prepared from an electrical insulating material, e.g., glass, and is oriented in such relation to plate 10 that anodes 30 are aligned with crystallized regions 20 of plate 10.

Thereafter, plate 10 is attached to support plate 60 via any suitable means. Frequently, a sealing glass frit having a fusing temperature lower than those of plates 10 and 60 is applied to contact areas on plate 10 and/or support plate 60. The assembly is then fired at a sufficiently high temperature to fuse the sealing glass frit and thereby bond plates 10 and 60 together. Finally, crystallized portions 20 are contacted with a mineral acid to etch out those regions leaving open slots 50.

The completed assembly comprises a matrix of cells which, after the attachment of leads thereto, can be utilized in a gas-filled display panel or other type of device which employs crossed electrodes and cell matrices. While not a requirement, the leads will desirably also be covered with a frit at the point of attachment to provide a measure of protection from mechanical abuse and atmospheric weathering.

The inventive assemblies readily lend themselves to the production of multi-unit structures since two or more individual units can be laid up in a desired configuration and bonded together through conventional frit sealing or other means.

Finally, where the higher strength and greater refractoriness of a glass-ceramic body is desired, the heat treatment will follow the manner disclosed in U.S. Pat. No. 2,971,853 and will consist of, first, subjecting the glass to temperatures between the annealing point and softening point thereof and, second, heating to temperatures above the softening point of the glass to develop a high degree of crystallization in the portions of the glass which were previously exposed to short wave radiation.

What is claimed is:

1. A method for making an electrode assembly comprising the steps of (a) exposing a plate of photosensitive, electrically insulating glass to ultraviolet radiation to develop a latent image therein in a pattern of parallel strips across a face of said plate, but not extending to the edges thereof;

(b) heat treating said plate at a temperature below the softening point of the glass to develop crystallites in the previously-exposed strip portions which can be selectively chemically removed from said glass plate;

(c) applying an array of first elongated electrodes to one surface of said plate in transverse orientation to said strip portions;

(d) contacting the obverse surface of said plate in at least said strip portions thereof with a solvent to selectively chemically remove said crystallites in said strip portions fully into said plate to form parallel slots therein; and (e) applying to the obverse surface of said plate having said parallel slots therein a support plate of electrically insulating glass carrying elongated parallel second electrodes, said support plate being oriented in such relation that the second electrodes carried thereby are aligned with and positioned within said slots, said second electrodes being transverse to said first electrodes and in operative relation therewith through said slots.

2. A method according to claim 1 wherein said heat treating consists of exposing said glass plate at a temperature above the annealing point of said glass but below the softening point thereof, and thereafter subjecting said plate to a temperature above the softening point of said glass to cause the generation of crystals therein.

3. A method for making an electrode assembly comprising the steps of (a) exposing a plate of photosensitive, electrically insulating glass to ultraviolet radiation to develop a latent image therein in a pattern of parallel strips across a face of said plate, but not extending to the edges thereof;

(b) heat treating said plate at a temperature below the softening point of the glass to develop crystallites in the previously-exposed strip portions which can be selectively chemically removed from said glass plate;

(c) applying an array of elongated parallel, strip-like first electrodes to one surface of said plate in transverse orientation to said strip portions and applying an array of elongated parallel, strip-like second electrodes to the opposite surface of said plate and oriented transverse to said first electrodes;

(d) contacting both surfaces of said plate in at least said strip portions thereof with a solvent to selectively chemically remove said crystallites in said strip portions to form parallel slots therein,with said first and second electrodes in operative relation with each other through said slots; and (e) applying to one surface of said plate, a support plate of electrically insulating glass.

4. The method of claim 3 wherein said first electrodes are disposed transverse to said second electrodes and said second electrodes are disposed in and lie along said slots.

5. A method according to claim 3 wherein said slots have essentially a rectilinear, V-shaped, or arc-shaped configuration.

6. A method according to claim 3 wherein said electrodes are applied through a technique selected from the group of silk screening, evaporation, RF sputtering, electroless metal plating, and vapor deposition.

7. A method according to claim 3 wherein leads are attached to said electrodes and said leads are covered with a glass frit.

8. A method according to claim 3 wherein said first array of electrodes is carried on a support plate which is attached to the surface of said plate.

9. A method according to claim 3 wherein said electrodes consist of a metal selected from the group of nickel, stainless steel, and other metal alloys having a coefficient of thermal expansion relatively closely matching that of said glass plate.

10. A method according to claim 3 wherein said crystallites are selected from the group of a lithium silicate and an alkali metal fluoride.

11. A method according to claim 17 wherein said solvent is a mineral acid.

12. A method according to claim 18 wherein said acid is dilute hydrofluoric acid.

* * * * *